US005180079A

United States Patent [19]

Jeng

[11] Patent Number: 5,180,079

[45] Date of Patent: Jan. 19, 1993

[54] COMBINED CUP

[76] Inventor: John Jeng, No. 131-1, Chung Cheng Rd., Taitung City, Taiwan

[21] Appl. No.: 863,004

[22] Filed: Apr. 6, 1992

[51] Int. Cl.[5] ..... B65D 6/00; B65D 21/02; B65D 51.28

[52] U.S. Cl. ..... 220/705; 220/709; 220/212; 220/505; 220/521; 220/524; 220/4.27; 220/23.83; 220/23.86; 426/85; 426/115; 426/120; 206/217; 206/541; 206/514; 229/103.1; 215/6; 215/1 A; 215/1 R

[58] Field of Search ..... 220/703, 705, 709, 212, 220/505, 521, 524, 4.27, 23.83, 23.86; 215/12.1, 6, 1 A, 1 R; 426/85, 86, 115, 120; 206/217, 541, 514, 501; 229/103.1

[56] References Cited

U.S. PATENT DOCUMENTS

| | | | |
|---|---|---|---|
| 1,665,289 | 4/1928 | Weaver | 206/217 X |
| 1,810,453 | 6/1931 | Webster et al. | 426/85 X |
| 2,327,077 | 8/1943 | Teetor | 220/23.86 |
| 2,604,976 | 7/1952 | Sarg | 426/120 |
| 2,836,323 | 5/1958 | Robinson | 220/4.27 |
| 3,288,344 | 11/1966 | Woollen et al. | 206/217 X |
| 3,323,706 | 6/1967 | Gereke | 426/85 X |
| 3,998,351 | 12/1976 | Smith et al. | 220/23.83 |
| 4,027,779 | 6/1977 | De Long | 206/501 X |
| 4,417,504 | 11/1983 | Yamamoto | 220/212 X |
| 4,595,099 | 6/1986 | Zaruba et al. | 220/4.27 X |
| 5,083,674 | 1/1992 | Clark | 220/4.27 |
| 5,085,330 | 2/1992 | Paulin | 215/6 |

FOREIGN PATENT DOCUMENTS

| | | | |
|---|---|---|---|
| 2023407 | 1/1980 | United Kingdom | 229/1.5 B |

*Primary Examiner*—Stephen Marcus
*Assistant Examiner*—Vanessa Caretto
*Attorney, Agent, or Firm*—Pro-Techtor International

[57] ABSTRACT

The combined cup of the present invention for soft drinks is constituted with an upper cup body and a lower cup body jointed together by a connecting body; and in the center of the connecting body, there is formed a nozzle sticking upward to be received into the nozzle sleeve formed on the upper cup body so as to keep both cup bodies firmly connected. The lower cup body is used to contain soft drink while the upper cup body is used to contain solid snacks. By applying such combined cup, the user can therefore enjoy the fun of eating and drinking with one hand holding the combined cup containing both snacks and drink and one hand free.

2 Claims, 3 Drawing Sheets

COMBINED CUP

FIELD OF THE INVENTION

The present invention relates to a combined cup for soft drinks which has an upper cup body and a lower cup body jointed together by a connecting body to enable the user to hold both soft drink and snacks with merely one hand and enjoy the fun of eating and drinking.

BRIEF DESCRIPTION OF PRIOR ART

Conventional cups for soft drinks as shown in FIG. 1 are formed into a cylinder without any other structure and are used for containing drinks only. To enjoy having snacks while drinking, one has to put down the drink cup in hand in order to hold the pack of snack and then eat. Such exchanging process can be very inconvenient, especially when one is in the outdoors or in a movie theater where there is no proper place for putting cups.

Considering of the foregoing inconvenience which decreases the enjoyment of eating and drinking, the present inventor has been working for improving the limit function of the conventional cups. The present invention is therefore achieved by a series of experimental designs and tries.

SUMMARY OF THE INVENTION

The object of the present invention is to provide a combined cup designed with two parts, the upper cup body and the lower cup body, which are connected together by a connecting body from between to contain simultaneously solid snacks and drink so that a user can hold the food with merely one hand and enjoy eating and drinking without inconvenience.

The detail structure and function in practice of the present invention can be further realized by the following specification and drawings.

CONTRAST OF THE TERMS AND NUMBERS OF THE PARTS

300—top lid
301—upper cup body
302—connecting body
302*a*—folded edge
303—lower cup body
303*a*—folded brim
304—nozzle
304*a*—nozzle brim
305—nozzle sleeve
306—straw
307—chamber.

DETAILED DESCRIPTION OF THE PRESENT INVENTION

Figure 1:
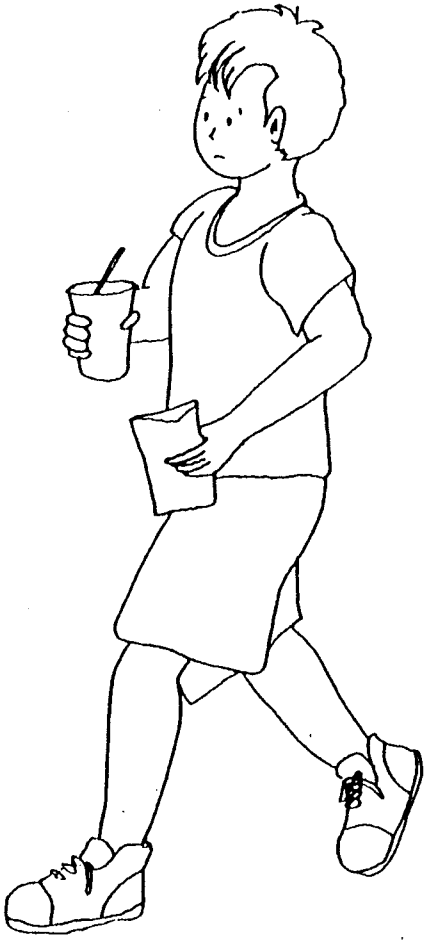
FIG. 1 shows a conventional cup in use by a consumer.

In FIG. 1, it is seen that the consumer is holding a conventional cup with a cylinder form for containing drink which will cause trouble when the consumer intends to eat snacks at the same time. This is an undesirable limit to enjoy food and drinks.

Figure 2:
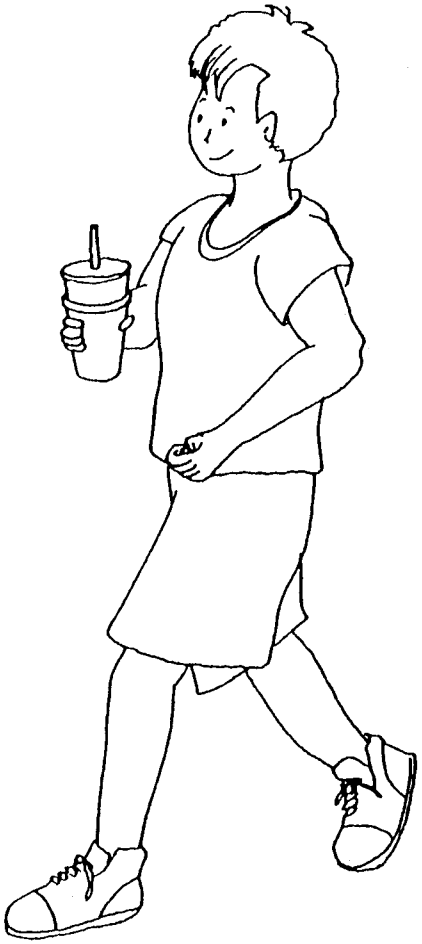
FIG. 2 shows the combined cup of the present invention in use by a consumer.

However, in FIG. 2 which shows the present invention in use, it is seen that the user holding the cup with one hand can remove the top lid of the cup to get snacks contained in the upper part, and drink with the straw sticking out from the lower part of the cup. A user with a conventional cup as in FIG. 1 who intends to eat snacks will have to put down the cup in order to hold the pack of snack with one hand and eat with the other hand. Comparing the different situations in the two figures, it is easily realized the practical effect of the present invention.

Figure 3:
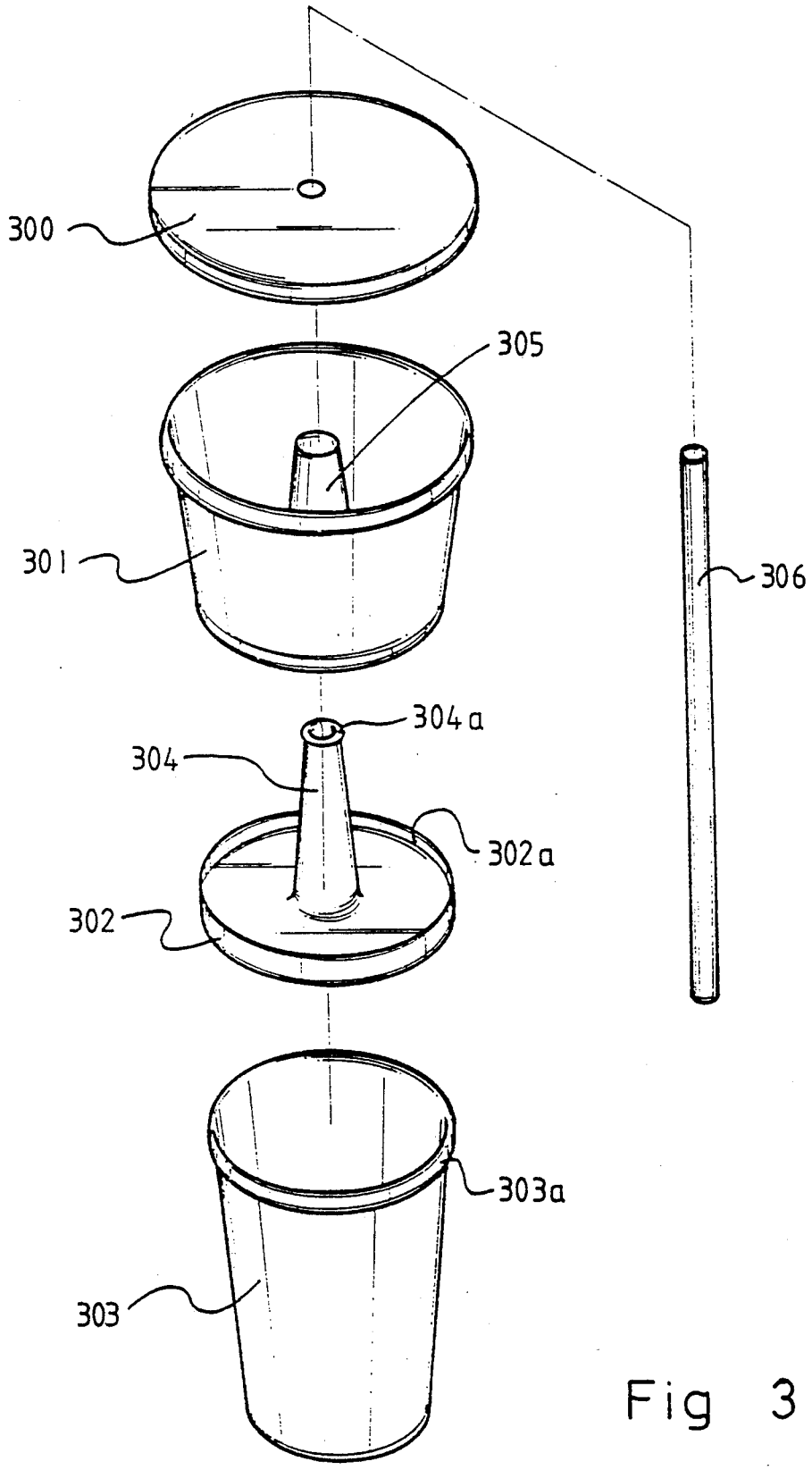
FIG. 3 is a disassembled perspective view of the present invention.

Referring now to FIG. 3, the combined cup of the present invention is provided with a top lid 300, an upper cup body 301, a connecting body 302, and a lower cup body 303. The lower cup body 303 is formed as a cylinder container without a top cover and is further provided with a folded brim 303*a* to fasten the connecting body 302 in combined condition. The connecting body 302 is designed as a disk with folded edge 302*a* around the circumference extending both upward and downward to hold, from below, the lower cup body 303 by the folded brim 303*a*, as well as to receive, from above, the bottom of the upper cup body 301. It is to be noted that in the center of the connecting body 302 there is formed a conical nozzle 304 sticking upward for receiving the drinking straw 306; and furthermore, the top of the nozzle is provided with a slightly jutted nozzle brim 304*a*. When the nozzle 304 is received into the nozzle sleeve 305 formed in the upper cup body 301, the jutted nozzle brim 304*a* extended out the sleeve 305 can be used to hold the nozzle 305 and therefore fasten the connecting body 302 and the upper cup body 301 together. The upper cup body 301 is formed as a container with an upward sticking nozzle sleeve 305 in the center which the top opening of the sleeve has an outer diameter slightly shorter than the diameter of the nozzle brim 304*a*. The upper cup body 301 is to be used for containing solid snacks, e.g. nuggets or french fries. A top lid 300 is provided to prevent the heat of the food in the upper cup body from dissipating.

Figure 4:
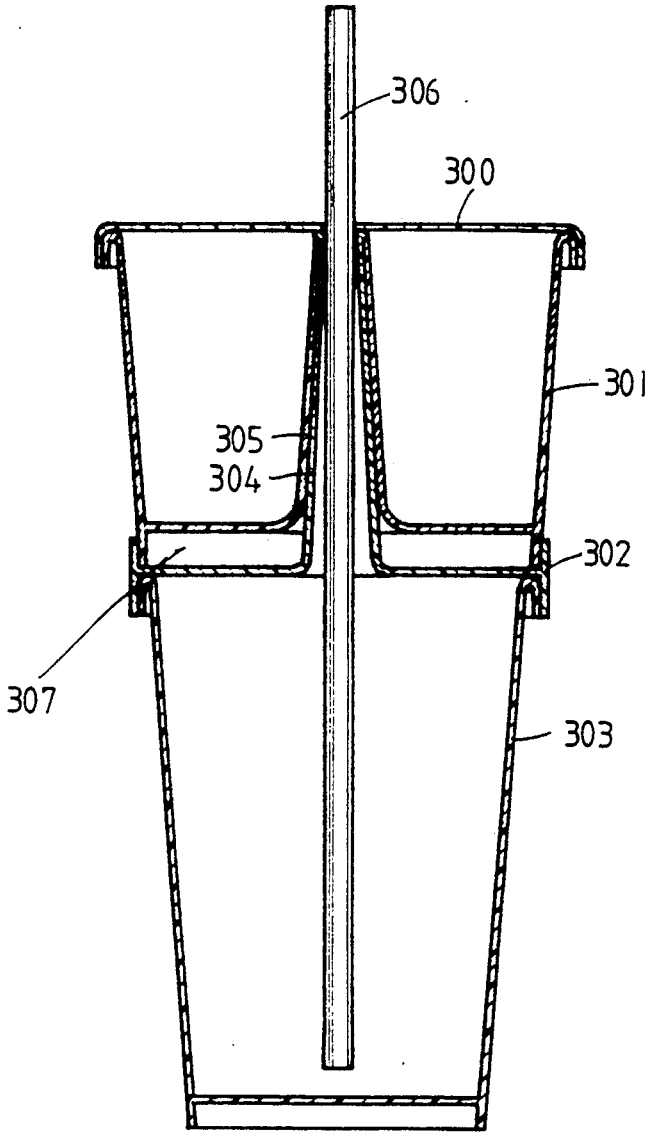
FIG. 4 is side-sectional view of the present invention in combination.

A side-sectional view as shown in FIG. 4 illustrates the inner structure of the present invention in combination with the top lid 300, upper cup body 301, connecting body 302, and the lower cup body 303. It is seen that the straw 306 can stick from the hole in the top lid 300 through the nozzle sleeve 305 of the upper cup body 301 and the nozzle 304 of the connecting body 302 to reach the bottom of the lower cup body 303. To get the food in the upper cup body 301, the user only need to remove the top lid 300; and when thirst is felt, the user can sip from the straw to get the drink contained in the lower cup body 303. Obviously, it is handy and timesaving to eat and drink without exchanging the cup and pack in hand. Furthermore, The chamber 307 formed between the connected upper cup body and the connecting body can function to prevent the heat of the food in upper cup body from being conducted to the cold drink in the lower cup body.

I claim:

1. A combined cup comprising a top lid, an upper cup body, a connecting body and a lower cup body which is characterized by that said upper cup body and said lower cup body are connected by said connecting body from between; wherein said connecting body is formed as a disk and is provided with a folded edge around the circumference extending both upward and downward to connect from below with said lower cup body by a folded brim of said lower cup body and connect from above with a bottom of said upper cup body; and an upward sticking conical nozzle is formed in a center of said connecting body for receiving a straw; said nozzle is further provided at a top with a jutted nozzle brim with an outer diameter slightly longer than an outer diameter of a nozzle sleeve formed in a center of said upper cup body.

2. A combined cup according to claim 1 which is further characterized by that said upper cup body is provided in the center with an upward sticking nozzle sleeve to receive said nozzle; wherein a top opening of said nozzle sleeve has an outer diameter slightly shorter than the outer diameter of said jutted nozzle brim.

* * * * *